US007980650B2

(12) United States Patent
Zhang et al.

(10) Patent No.: US 7,980,650 B2
(45) Date of Patent: Jul. 19, 2011

(54) SYSTEM AND METHOD FOR CALIBRATING A PRINTING SYSTEM TO COMPENSATE FOR SENSOR ARTIFACT USING NON-COMPLEMENTARY ILLUMINATIONS OF TEST PATTERNS ON AN IMAGE SUBSTRATE

(75) Inventors: Yeqing Zhang, Penfield, NY (US); Howard A. Mizes, Pittsford, NY (US); Luo Cheng, Beaverton, OR (US)

(73) Assignee: Xerox Corporation, Norwalk, CT (US)

( * ) Notice: Subject to any disclaimer, the term of this patent is extended or adjusted under 35 U.S.C. 154(b) by 1014 days.

(21) Appl. No.: 11/890,879

(22) Filed: Aug. 8, 2007

(65) Prior Publication Data

US 2009/0040261 A1 Feb. 12, 2009

(51) Int. Cl.
*B41J 29/393* (2006.01)

(52) U.S. Cl. ..... 347/19; 356/402; 356/404; 356/408

(58) Field of Classification Search ..... None
See application file for complete search history.

(56) References Cited

U.S. PATENT DOCUMENTS 4,670,779 A * 6/1987 Nagano ..... 358/512
4,718,768 A * 1/1988 Houki et al. ..... 356/402
5,073,028 A * 12/1991 Bowden et al. ..... 356/402
5,345,863 A 9/1994 Kurata et al.
5,389,958 A 2/1995 Bui et al.
5,406,315 A 4/1995 Allen et al.
5,774,155 A 6/1998 Medin et al.
5,777,650 A 7/1998 Blank
5,793,398 A 8/1998 Hennig
6,113,231 A 9/2000 Burr et al.
6,196,675 B1 3/2001 Deily et al.
6,361,230 B1 3/2002 Crystal et al.
6,485,140 B1 11/2002 Lidke et al.
6,494,570 B1 12/2002 Snyder

* cited by examiner

*Primary Examiner* — Uyen-Chau N Le
*Assistant Examiner* — Chad H Smith
(74) *Attorney, Agent, or Firm* — Maginot, Moore & Beck LLP

(57) ABSTRACT

A system removes a light sensor artifact from a light sensor in a printer that is used to obtain reflectance measurements from test patterns printed on an image substrate. The system includes a print head for ejecting a plurality of pixels having a first single color in a test pattern onto an image substrate, a light source for illuminating the test pattern on the image substrate with a light, a light sensor for measuring reflectance of the first portion of the test pattern with reference to a light having a color that is non-complementary to the first single color of the test pattern, measuring reflectance of the first portion of the test pattern with reference to a light that is complementary to the first single color of the test pattern, and measuring reflectance of the second portion of the test pattern with reference to the complementary light, the second portion including an area that overlaps the first portion of the test pattern, and a sensor controller configured to scale the reflectance of the first portion measured with reference to the non-complementary light to minimize a difference between the reflectance of the first portion measured with reference to the complementary light and the reflectance of the second portion measured with reference to the complementary light in the overlapped area.

15 Claims, 4 Drawing Sheets

SYSTEM AND METHOD FOR CALIBRATING A PRINTING SYSTEM TO COMPENSATE FOR SENSOR ARTIFACT USING NON-COMPLEMENTARY ILLUMINATIONS OF TEST PATTERNS ON AN IMAGE SUBSTRATE

CROSS-REFERENCED APPLICATION

This disclosure cross-references co-pending patent application entitled "Ink-Jet Printer Using Phase-Change Ink Printing On A Continuous Web," which was filed on Jul. 5, 2007 and assigned Ser. No. 11/773,549. That application is commonly owned by the assignee of the subject matter set forth below.

TECHNICAL FIELD

This disclosure relates generally to printer print head calibrations and, more particularly, to print head calibration systems that use linear arrays of photosensitive sensors to measure ink drop mass density on image substrates.

BACKGROUND

Linear sensor arrays are used in printers to measure ink densities ejected by nozzles of a print head. The sensor array is mounted with reference to a light source and an image substrate, such as a print drum or belt. The light source includes a red light emitting diode (LED), a green LED, and a blue LED. The LEDs are operated independently so only one LED may be illuminated at a time. Alternatively, the sensor array, comprised of a set of red filtered photo sensors, a set of blue filtered photo sensors, and a set of green filtered photo sensors, may be illuminated with white light. The light from an illuminated LED is carried by a light pipe that has a length corresponding to the length of a sensor array, which operates as an uniformity sensor. The light is directed towards the image substrate, which typically is a rotating drum or belt. In these types of printers, an image is ejected onto the substrate and then transferred to a media sheet. The sensor array is positioned to receive the light reflected by the image substrate. When the substrate is bare, the light is reflected specularly and the response of the sensor array is large. When a test pattern is printed onto the image substrate and the light is directed towards this test pattern, the specular reflection is decreased, but the diffuse reflection increases. The differences in the specular reflectance measurements detected by the sensors in a sensor array for different test patterns are correlated to the densities of the ink on the substrate at the positions that reflected light into the sensors. These density measurements are used to adjust driving signals to the nozzles or to modify the input gray level spatially in an effort to present a printed pattern with uniform ink densities and correct registration.

The sensor array detecting the light reflected by the print drum includes a plurality of photosensitive devices that are typically arranged linearly. For example, a sensor array may be a plurality of charge coupled devices (CCDs) that are linearly aligned with 600 CCDs per linear inch. An 8.5 inch wide sensor array, consequently, has 5100 CCDs. Slight differences in the characteristics of each photosensitive device in an array cause the devices to respond differently to various amounts of illumination. That is, the signal generated by one photosensitive device in the array in response to a reflected light signal may differ from the signal generated by another photosensitive device in the array in response to the same amount of reflected light.

Another problem with the reflectance measurements obtained by sensor arrays is the structure of the image substrate. Many image substrates are rough and highly structured. Some sections of the surface reflect light more intensely into the light sensor, while other sections reflect light away from the sensor array and appear dimmer. In an effort to have the sensor array produce a more uniform response to reflected light, a two dimensional (2D) calibration process may be performed. The 2D calibration process begins with a capture of the sensor array response as the image substrate rotates underneath the sensor. This sensor array response is called a bare substrate response. The bare response is obtained by illuminating the substrate with the red light and obtaining the response with the light sensor, illuminating the substrate with the green light and obtaining the light sensor response, and illuminating the substrate with the blue light and obtaining the light sensor response. Alternatively, the bare response could be obtained by illuminating the image substrate with white light and then obtaining a response with the red-filtered sensors, the green-filtered sensors, and the blue-filtered sensors. After the bare response is measured, the 2D calibration process continues with a capture of the sensor array response without any illumination. This sensor array response is called the dark response. The final step of the 2D calibration process is to print a test pattern onto the image substrate and monitor the sensor array response as the image substrate rotates beneath the sensor array. This response is called the uncalibrated response. For each pixel in the test pattern, the difference between an uncalibrated pixel and the corresponding pixel in the dark response and the difference between a bare substrate pixel and the corresponding pixel in the dark response are computed. A calibrated image is then calculated as the ratio between the two differences at each pixel location.

In some systems, the linear array of photo sensors is not as wide as the image member width. In these situations, the sensor array must be moved to one or more different positions across the image substrate so a calibration may be performed at each sensor position. For example, an 8.5 inch sensor array may be used to capture an image of a twelve inch wide image substrate by mounting the sensor array on a carriage member so the sensor array is shifted 3.5 inches to capture the remaining portion of the print drum not captured in the first image. Of course, the first five inches of the second image overlaps with the last five inches of the first image. In this description, the first image is called a front print drum image and the second image is called a back print drum image.

In theory, the 2D calibration process should result in the front image of a drum being the same as the back image of the drum. In reality, this does not occur. As shown in FIG. 1, three reflectance measurements for front images of a drum onto which three test patterns have been printed are shown by curves 10, 12, and 14. Curve 10 is the reflectance measurement for the front image of the densest test pattern and curve 14 is the reflectance measurement for the front image of the least dense test pattern. The reflectance measurements for the three back images of the drum are shown by curves 16, 18, and 20. The overlap between the front images and the back images, which occur in the area denoted OA in FIG. 1, should be approximately the same because the same portion of the test pattern is being measured. Instead, the measurement curves are different and are evidence of an artifact in the measured responses caused by the sensor array. These response differences arise because the amount of diffusely reflected light collected across the sensor array varies. This collected light is caused by variations in the illumination system and focusing optics. The bare image substrate response collected during the 2D calibration process monitors only specularly reflected light so it cannot be used to calibrate these variations in diffusely reflected light. The higher the ink density in a test pattern, the more severe the sensor artifact becomes. The response difference is especially evident in the overlap area of the two measurements. Thus, the light sensor exhibits an artifact that affects the ink uniformity measurements for the printer. As shown by the curves in FIG. 1, the reflectance measurements for the higher density ink pattern portrayed in the curves 10, 16 reveal the sensor artifact more vividly than the reflectance measurements for the lower density ink pattern shown in the curves 14, 20 and 12, 18.

SUMMARY

A system has been developed that removes a light sensor artifact from a light sensor in a printer that is used to obtain reflectance measurements from test patterns printed on an image substrate. The system includes a print head for ejecting a plurality of pixels having a first single color in a test pattern onto an image substrate, a light source for illuminating the test pattern on the image substrate with a light, a light sensor for measuring reflectance of the first portion of the test pattern with reference to a light having a color that is non-complementary to the first single color of the test pattern, measuring reflectance of the first portion of the test pattern with reference to a light that is complementary to the first single color of the test pattern, and measuring reflectance of the second portion of the test pattern with reference to the complementary light, the second portion including an area that overlaps the first portion of the test pattern, and a sensor controller configured to scale the reflectance of the first portion measured with reference to the non-complementary light to minimize a difference between the reflectance of the first portion measured with reference to the complementary light and the reflectance of the second portion measured with reference to the complementary light in the overlapped area.

A method that may be implemented with the system described above removes a sensor artifact from reflectance measurements generated by a light sensor. The method includes ejecting a test pattern onto an image substrate, the test pattern being comprised of a plurality of pixels having a first single color, illuminating the test pattern on the image substrate with a light having a color that is non-complementary to the first single color of the test pattern, measuring reflectance of a first portion of the test pattern illuminated with the non-complementary light, illuminating the test pattern on the image substrate with a light having a color that is complementary to the first single color of the test pattern, measuring reflectance of the first portion of the test pattern illuminated with the complementary light, measuring reflectance of a second portion of the test pattern illuminated with the complementary light, the second portion including an area that overlaps the first portion of the test pattern, and scaling the reflectance of the first portion illuminated with non-complementary light with a scaling factor that corresponds to a minimized difference between the reflectance of the first portion illuminated with complementary light and the reflectance of the second portion illuminated with complementary light in the overlapped area.

BRIEF DESCRIPTION OF THE DRAWINGS

The foregoing aspects and other features of a system and method that enable a sensor artifact to be minimized in reflectance measurements obtained by a light sensor are explained in the following description, taken in connection with the accompanying drawings, wherein.

DETAILED DESCRIPTION

Figure 2:
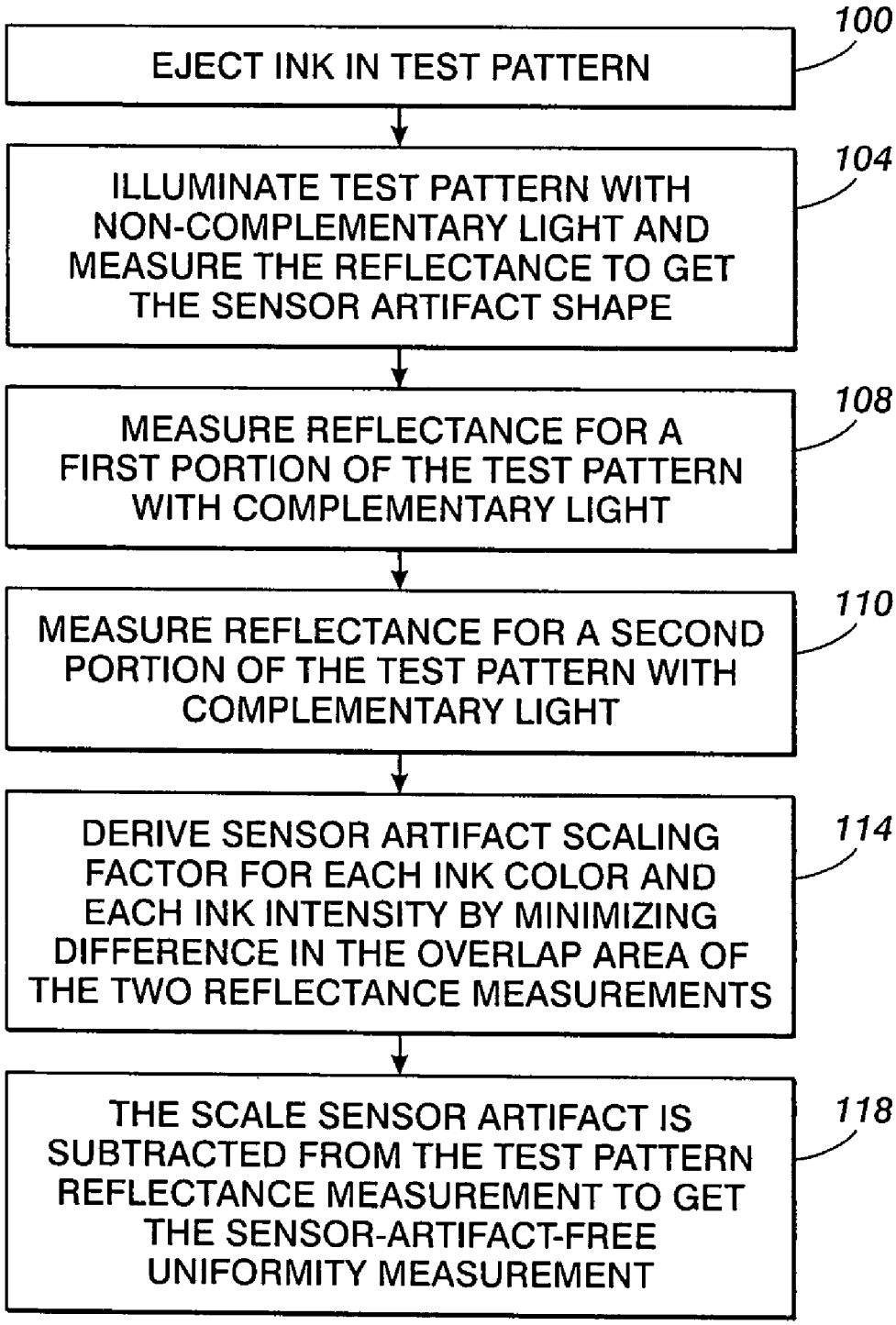
FIG. 2 is a flow diagram of a method for generating a scaling factor that attenuates a sensor artifact in the light sensor used to obtain the reflectance measurements of FIG. 1.

A method for minimizing a sensor artifact in reflectance measurements obtained from a light sensor in an ink printer is shown in FIG. 2. The method begins with the ejection of a test pattern onto an image substrate (block 100). The test pattern is comprised of a plurality of pixels formed by ejecting ink from the ink jet nozzles of a print head. Test patterns for evaluating the uniformity of the density of the ink drops expelled by a print head at a particular gray scale level are well known. In the method shown in FIG. 2, the pixels of the test pattern are ink drops of a single color. For example, a color printer typically includes sources of cyan ink, magenta ink, yellow ink, and black ink. Thus, the test pattern ejected onto an image substrate is formed with pixels of one of those colored inks.

Figure 3:
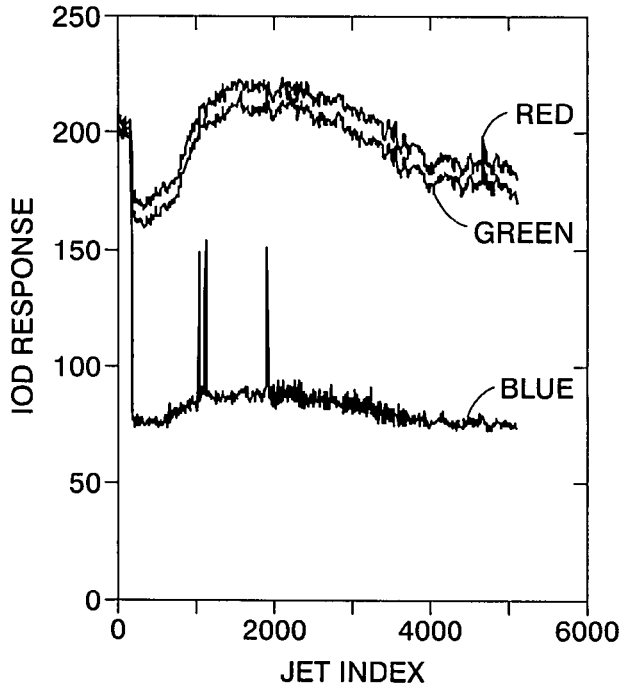
FIG. 3 is a graph of reflectance measurements of a test pattern illuminated with red light, green light, and blue light.

After the test pattern has been printed onto the image substrate, the test pattern is illuminated with a light source and the reflectance is measured with reference to a light color that is non-complementary to the single color of the test pattern (block 104). The illumination may be with a white light and the reflectance measured with light sensors that are filtered for the non-complementary color. Alternatively, a LED may be activated that illuminates the image member with a light that is non-complementary to the single color of the test pattern and the reflectance may be measured with non-filtered light sensors. "Non-complementary" refers to a light having a wavelength that is not absorbed by the ink in the test pattern. For example, reflectance measurements of a yellow ink test pattern taken under red light, green light, and blue light are shown in FIG. 3. The red light and green light are non-complementary colors, but the blue light is more strongly absorbed by the yellow ink and is complementary to the yellow ink. Consequently, the reflectance obtained by the light sensor for the red and green lights are dominated by diffusely reflected light while the reflectance obtained by the light sensor in response to the reflected blue light is dominated by specularly reflected light. Variations in the diffusely reflected light caused by sensor illumination/optics differences along the array of sensors are not eliminated by the 2D calibration process. Under non-complementary illumination, the uncalibrated diffuse variations dominate any changes in the specular signal arising from ink variations. Under complementary illuminations, residual diffuse reflections contribute in an unwanted way to the desired specular response. Because the reflectance measurements for the red light are more diffused than the green light reflections, the red light reflections are preferred for sensor artifact analysis over the green light reflections. The green light reflections, however, could be used with the yellow ink pattern for obtaining the sensor artifact shape.

Figure 1:
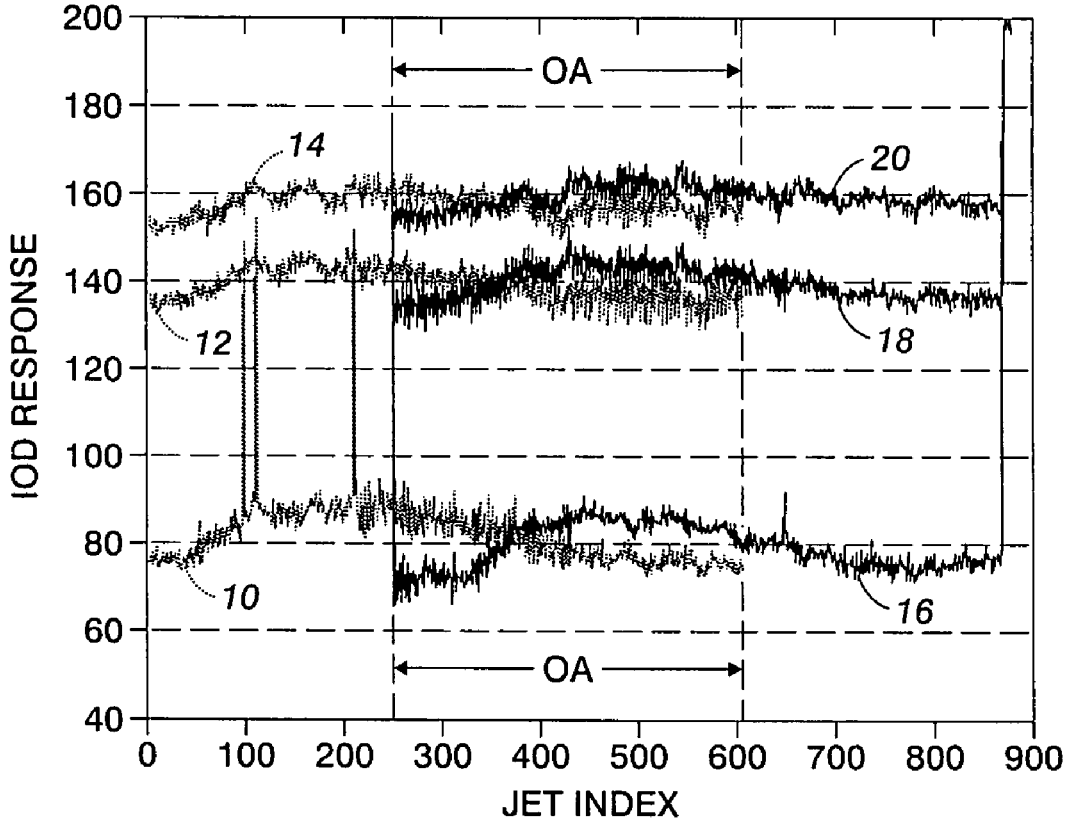
FIG. 1 is a graph of reflectance measurements, which contain a sensor artifact, for three test patterns with different ink densities.

The process continues with the test pattern being illuminated again and a reflectance measurement for a first portion of the test pattern is obtained with reference to a light that is complementary to the single color of the test pattern (block 108). Again, the illumination of the test pattern may be with white light and the reflectance measured with light sensors that are filtered for the complementary color. Alternatively, a LED may be activated that illuminates the image member with a light that is complementary to the single color of the test pattern and the reflectance may be measured with non-filtered light sensors. The light sensor used to measure the reflectance may be, for example, a linear array of photosensitive sensors, such as charge coupled devices (CCDs). The array may be approximately 8.5 inches long with approximately 600 CCDs per inch. Therefore, the sensors are only able to measure the reflectance from a portion of a twelve (12) inch wide image substrate, such as a rotating print drum or belt. In one embodiment, a first portion of a test pattern refers to the first 8.5 inches of a rotating image substrate surface extending from the left end of the drum. The light sensor array is translated across the surface of the substrate by 3.5 inches and a reflectance measurement for a second portion of the test pattern made with reference to the complementary light is obtained (block 110). The illumination may be with white light and the reflectance measured with light sensors that are filtered for the complementary color. Alternatively, a LED may be activated that illuminates the image member with a light that is complementary to the single color of the test pattern and the reflectance may be measured with non-filtered light sensors. In the embodiment having the movable light sensor array, the rightmost five inches of the reflectance measurement of the first portion and the leftmost five inches of the reflectance measurement of the second portion form an overlapping area for the two reflectance measurements. By juxtaposing the two reflectance measurement curves, an artifact for the sensor may be identified in the overlap area between the two curves. For example, the sensor artifact is demonstrated in the area OA of FIG. 1.

Figure 4:
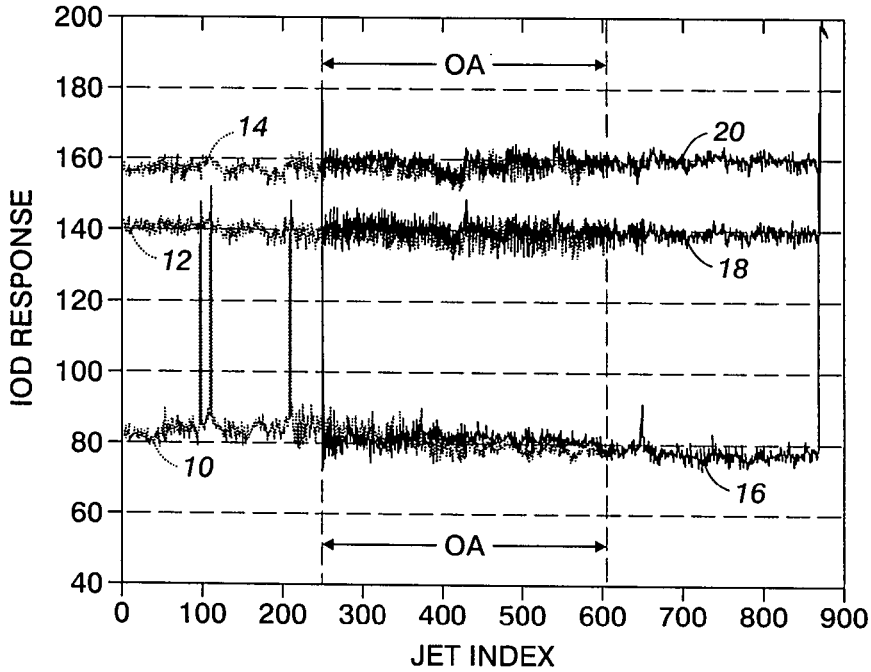
FIG. 4 is a graph of reflectance measurements of a test pattern after a scaling factor that attenuates a sensor artifact has been applied to remove the sensor artifact in the reflectance measurements of FIG. 1.

The method of FIG. 2 minimizes the differences between the reflectance of the first portion and the reflectance of the second portion in the overlapped area to generate a scaling factor (block 114). The scaling factor may then be used to attenuate the sensor artifact in subsequent reflectance measurement curves obtained from the non-complementary light sensor. In one embodiment, the scaling factor may be generated by minimizing a sum of squared differences between the reflectance of the first portion and the reflectance of the second portion in the overlapped area. Of course, other minimizing methods may be used to identify a scaling factor. Once the scaling factor is identified by the error minimization technique, the scaling factor may be used on reflectance measurements generated by the light sensor to attenuate the sensor artifact in the reflectance measurements. The attenuated sensor artifact is subtracted from reflectance measurements of the test pattern to achieve a sensor-artifact-free uniformity measurement (block 118). Use of the scaling factor in this manner is shown in FIG. 4. As shown in that figure, the reflectance measurements for the front and back images of the three test patterns in the overlapped area are very close. Consequently, the reflectance measurements in the overlapped area no longer contain a sensor artifact. Attenuation of the sensor artifact with the scaling factor accurately predicts the sensor artifact for different ink colors and different ink densities. The removal of the sensor artifact enables the reflectance measurements generated by the light sensor to provide a more accurate representation of the uniformity of the ink on the image substrate.

The scaling factor may be described mathematically in the following manner. Let $P_c(j)$ be the reflectance measurement for the overlap area of the test pattern illuminated with a complimentary color LED for a jet j, $P_{nc}(j)$ be the reflectance measurement for the overlap area of the test pattern illuminated with a non-complimentary color LED for jet j, and P(j) be the sensor-artifact-free reflectance measurement for jet j. The relationship between $P_c(j)$, $P_{nc}(j)$ and P(j) is given by: $P(j)=P_c(j)-\beta*P_{nc}(j)$, where β is a constant scalar. Assuming that $P_{nc}(j)$ contains only the sensor signature and insignificant contributions from the test pattern uniformity, the overlap between the front and back profiles can be used as a metric to determine the scaling factor β. The sum of the squares of the difference in the overlap region is one metric for the overlap area. When the reflectance measurements correspond closely to one another, this metric is at a minimum. Therefore, adjusting the scaling factor to minimize the reflectance measurement differences in the overlap area attenuates the sensor artifact. In general, β is a function of ink color and test pattern density. The overlap may be minimized separately for each ink color and each test pattern density. Alternatively, rules that scale the sensor artifact with ink color and ink density may be used to determine β.

The method described above may be repeated with a test pattern of a different single color that is illuminated with a light color that is non-complementary to the ink color of the test pattern to obtain a scaling factor for the light sensor corresponding to the second ink color. The method may also be used with a light sensor having a two or more linear arrays of light sensing devices. With this type of light sensor, the test pattern moves after a first row of light sensing devices receives the light reflected by the test pattern so a second row of light sensing devices receives the light reflected by the test pattern. Again, the differences between the two reflectance measurements are minimized to generate a scaling factor for later reflectance measurements.

Figure 5:
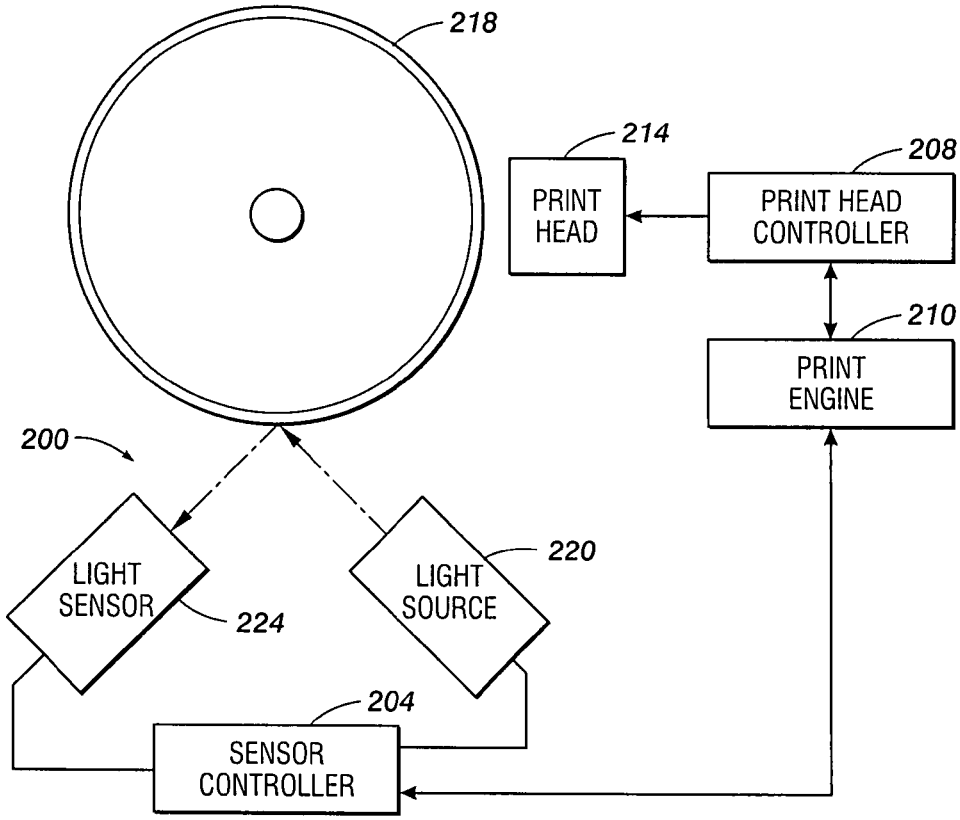
FIG. 5 is a block diagram of a system that may be used to implement the method of FIG. 2.

A system is depicted in FIG. 5 that may be used to perform the method shown in FIG. 2. The system 200 includes a print head controller 204 and a sensor controller 208 that are coupled to a print engine 210. The print engine 210 receives document data that are processed to generate control signals for the operation of a printer. After processing document data with device dependent filters, such as tone reproduction curves (TRCs), for example, pixel data may be provided to the print head controller 204 for generation of print head driving signals that are coupled to a print head 214. Of course, the printer may include multiple print heads coupled to the print head controller 204 as is well known. The print head driving signals cause piezoelectric elements to eject ink selectively onto an image substrate, such as a rotating print drum 218, for example. To perform the process for attenuating a sensor artifact, the print engine 210 processes test pattern data stored in a memory associated with the print engine 210 with device dependent filters to generate pixel data for the print head controller 208. The print head controller 208 generates the driving signals that cause the print head 214 to eject a test pattern in a first single color onto the image substrate.

Mounted proximate to the image substrate 218 are a light source 220 and a light sensor 224. The light source may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source 220 is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The LEDs of the light source are coupled to the sensor controller 208, which selectively activates the LEDs. The sensor controller 208 receives a signal from the print engine 210 that indicates which LED or LEDs to activate in the light source. For example, the print engine 210 may generate pixel signals for the print head controller 204 to produce driving signals that cause the print head 214 to eject a test pattern with yellow ink pixels onto the image substrate 218. For sensor artifact processing, the print engine 210 also generates a signal for the sensor controller 208 that indicates the sensor controller is to activate the red LED or LEDs in the light source 220.

The reflected light is measured by the light sensor 224. The light sensor 224, in one embodiment, is a linear array of photosensitive devices, such as charge coupled devices (CCDs). The photosensitive devices generate an electrical signal corresponding to the intensity or amount of light received by the photosensitive devices. These electrical signals may be summed to generate a reflectance measurement signal for a test pattern. The linear array may be configured to translate across the image substrate. For example, the linear array may be mounted to a movable carriage that translates across the image substrate 218 to illuminate a first portion and a second portion of the test pattern on the image substrate. This arrangement enables a linear array that is shorter than the width of the image substrate to be moved to obtain two reflectance measurements for the image substrate that share an overlapped area. Other devices for moving the light sensor may also be used.

The reflectance signals obtained by the light sensor 224 may be provided to the sensor controller 208 for generation of the scaling factor. In this embodiment, the sensor controller 208 is configured to minimize the differences between the two reflectance signals to produce the scaling factor for sensor artifact attenuation. Alternatively, the sensor controller 208 may store the reflectance signals in a memory shared with the print engine 210 so the print engine 210 may minimize the differences between the two signals and generate the scaling factor.

The sensor controller, print head controller, and print engine described herein and the functions that they perform may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the difference minimization function, described above. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

In operation, a print engine is configured to generate pixel data for test patterns in a single color. The single color test patterns are illuminated by a non-complementary light and the resulting reflectance is measured to get the sensor artifact shape. The light sensor is controlled to read the first portion of the test pattern illuminated with a complementary color and then read the second portion of the test pattern illuminated with a complementary color, the second portion including an area that overlaps the first portion of the test pattern. The reflectance measurements for the overlapped area are compared and the differences between the two measurements minimized to generate a scaling factor that may be used to attenuate sensor artifact in the reflectance measurements generated by the light sensor. The scaled sensor artifact is subtracted from reflectance measurements to get artifact-free measurements of the uniformity test pattern.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

We claim:

1. A system for removing a light sensor artifact from reflectance measurements comprising:

a print head for ejecting a plurality of pixels having a first single color in a test pattern onto an image substrate;

a light source for illuminating the test pattern on the image substrate with a light;

a light sensor configured to generate a reflectance measurement for a first portion of the test pattern with reference to a light having a color that is non-complementary to the first single color of the test pattern, to generate a reflectance measurement for the first portion of the test pattern with reference to a light having a color that is complementary to the first single color of the test pattern, and to generate a reflectance measurement for a second portion of the test pattern with reference to the light having a color that is complementary to the first single color of the test pattern, the second portion including an area that overlaps the first portion of the test pattern; and a sensor controller operatively connected to the light sensor and configured to scale the reflectance measurement of the first portion generated with reference to the light having a color that is non-complementary to the first single color of the test pattern to minimize a difference between the reflectance measurement of the first portion generated with reference to the light having a color that is complementary to the first single color of the test pattern and the reflectance measurement of the second portion generated with reference to the light having a color that is complementary to the first single color of the test pattern in the overlapped area.

2. The system of claim 1, the light source being operated to illuminate the test pattern with a white light; and the light sensor further comprising:

a plurality of photosensitive devices arranged in a linear array, the reflectance measurement of the first portion of the test pattern generated with reference to the light having a color that is non-complementary to the first single color of the test pattern is generated with photosensitive devices filtered for light having a color that is non- complementary to the first single color of the test pattern and the reflectance of the first portion and the second portion generated with reference to the light having a color that is complementary to the first single color of the test pattern is generated with photosensitive devices filtered for the light having a color that is complementary to the first single color of the test pattern.

3. The system of claim 1, the light source further comprising:

a plurality of LEDs;

the sensor controller being operatively connected to the plurality of LEDs to activate one of the LEDs in the plurality of LEDs for generation of a light having a color that is non-complementary to the first single color and to activate another LED in the plurality of LEDs for generation of a light having a color that is complementary to the first single color; and the light sensor generating the reflectance measurement of the first portion with reference to the light having a color that is non-complementary to the first single color of the test pattern while the test pattern is illuminated with the light having a color that is non-complementary to the first single color of the test pattern and the light sensor generating the reflectance measurement of the first portion and the second portion with reference to the light having a color that is complementary to the first single color of the test pattern while the test pattern is illuminated with the light having a color that is complementary to the first single color of the test pattern.

4. The system of claim 3, the plurality of LEDs including a LED that emits red light when activated, a LED that emits green light when activated, and a LED that emits blue light when activated.

5. The system of claim 1, the light source further comprising:

a plurality of LEDs arranged in a linear array that is mounted at a position to direct light towards a rotating image member.

6. The system of claim 1, the light sensor being configured to move across the image substrate to enable the reflectance measurement of the first portion and the second portion of the test pattern.

7. The system of claim 6, the light sensor further comprising:

a plurality of photosensitive devices arranged in a linear array mounted to a movable carriage that translates across a rotating image member to generate a reflectance measurement of the first portion and the second portion of the test pattern.

8. The system of claim 7, the sensor controller being configured to minimize a sum of squared differences between the reflectance measurement of the first portion illuminated with the light having a color that is complementary to the first single color of the test pattern and the reflectance measurement of the second portion illuminated with the light having a color that is complementary to the first single color of the test pattern in the partially overlapped area.

9. A printer comprising:

a rotating image member;

a print head for ejecting ink onto the rotating image member; a print head controller for sending ink jet driving signals to the print head to eject ink onto the rotating image member; a light source mounted at a position proximate to the rotating image member to illuminate a portion of the rotating image member;

a light sensor mounted on a movable member to translate the light sensor across the rotating image member to receive light reflected by the rotating image member from the light source;

a sensor controller operatively connected to the light sensor and light source, the sensor controller being configured to activate the light source for selective illumination of the rotating image member, to translate the light sensor to different positions proximate the rotating image member, and to receive reflectance measurements from the light sensor; and a print engine coupled to the sensor controller and the print head controller, the print engine being configured to control the print head controller to send ink jet driving signals to the print head for the ejection of a test pattern having pixels of a first single color onto the rotating image member and to control the sensor controller to activate the light source to illuminate the rotating image member with a first light having a color that is non-complementary to the first single color and with a second light having a color that is complementary to the first single color; the sensor controller being configured to move the light sensor to a first position to generate a reflectance measurement of a first portion of the test pattern on the rotating image member and to a second position that partially overlaps the first portion of the test pattern to generate a reflectance measurement of a second portion of the test pattern; the print engine being configured to minimize differences between the reflectance measurement of the first portion of the test pattern illuminated by the light having a color that is complementary to the first single color of the test pattern and the reflectance measurement of the second portion of the test pattern illuminated by the light having a color that is complementary to the first single color of the test pattern to generate a scaling factor for reduction of a light sensor artifact in the reflectance measurement of the first portion of the test pattern illuminated by the light having a color that is non-complementary to the first single color of the test pattern.

10. The printer of claim 9, the sensor controller being configured to activate the light source to generate one of a red light, a green light, and a blue light.

11. The printer of claim 9, the print head controller being configured to send a driving signal to the print head to eject a test pattern in the single first color of cyan, magenta, or yellow.

12. The printer of claim 9, the print engine being configured to minimize a sum of squared differences between the reflectance measurement of the first portion illuminated with the first light and the reflectance measurement of the second portion illuminated with the second light in the partially overlapped area.

13. The printer of claim 9, the light source further comprising:

a plurality of LEDs;

the sensor controller being coupled to the plurality of LEDs to activate one of the LEDs in the plurality of LEDs for generation of a light having a color that is non-complementary to the first single color and to activate another LED in the plurality of LEDs for generation of a light having a color that is complementary to the first single color; and the light sensor generating reflectance measurements of the first portion with reference to the light having a color that is non-complementary to the first single color of the test pattern while the test pattern is illuminated with the light having a color that is non-complementary to the first single color of the test pattern and the light sensor generating reflectance measurements of the first portion and the second portion with reference to the light having a color that is complementary to the first single color of the test pattern while the test pattern is illuminated with the light having a color that is complementary to the first single color of the test pattern.

14. The printer of claim 9, the light source being operated to illuminate the test pattern with a white light; and the light sensor further comprising:

a plurality of photosensitive devices arranged in a linear array, the reflectance measurement of the first portion of the test pattern measured with reference to the light having a color that is non-complementary to the first single color of the test pattern is measured with photosensitive devices filtered for the light having a color that is non- complementary to the first single color of the test pattern and the reflectance measurement of the first portion and the second portion measured with reference to the light having a color that is complementary to the first single color of the test pattern is measured with photosensitive devices filtered for the light having a color that is complementary to the first single color of the test pattern.

15. The printer of claim 13, the light sensor further comprising:

a plurality of photosensitive devices arranged in a linear array mounted to a moveable member that translates across a rotating image member to generate a reflectance measurement of the first portion and the second portion of the test pattern.

* * * * *